United States Patent [19]

Terajima

[11] 4,417,107

[45] Nov. 22, 1983

[54] SLIDE SWITCH

[75] Inventor: Jiro Terajima, Furukawa, Japan

[73] Assignee: Alps Electric Co., Ltd., Tokyo, Japan

[21] Appl. No.: 349,754

[22] Filed: Feb. 18, 1982

[30] Foreign Application Priority Data

Feb. 18, 1981 [JP] Japan ..... 56-20727[U]

[51] Int. Cl.[3] ..... H01H 15/00

[52] U.S. Cl. ..... 200/16 C; 200/16 D

[58] Field of Search ..... 200/11 G, 11 K, 11 J, 200/16 R, 16 B, 16 C, 16 D, 16 E, 16 F

[56] References Cited

U.S. PATENT DOCUMENTS

| | | | |
|---|---|---|---|
| 3,024,334 | 3/1962 | Rhodes | 200/11 K X |
| 3,187,119 | 6/1965 | Dyksterhouse | 200/16 C |
| 3,431,374 | 3/1969 | Raab | 200/16 C X |
| 3,525,828 | 8/1970 | Eckhart et al. | 200/16 D |
| 3,549,832 | 12/1970 | Ferryman, Jr. | 200/16 C |
| 3,757,060 | 9/1973 | Ianuzzi et al. | 200/16 C |
| 4,022,994 | 5/1977 | Raab et al. | 200/16 C |
| 4,042,795 | 8/1977 | Sykora | 200/16 D |
| 4,210,791 | 7/1980 | Sorenson | 200/164 R |

*Primary Examiner*—J. R. Scott

*Attorney, Agent, or Firm*—Guy W. Shoup; Gerard F. Dunne

[57] ABSTRACT

A slide switch having an insulating substrate, a plurality of stationary contact segments including a common contact segment and a plurality of switching segments and arranged in a row, and a movable contact having segments adapted to slide in contact with the stationary contact segments. The insulating substrate has a longitudinal groove extended along the row of the stationary contact segments. The stationary contact segments are disposed to be raised to a height above the groove and to also straddle the groove. The movable contact segments have a width less than that of the groove and thus are adapted to slide within the width of the groove. Each movable contact segment can have sliding tabs formed at both sides thereof and adapted to slide in contact with guide steps formed on the insulating substrate at respective sides of the row of the movable contact segments.

2 Claims, 5 Drawing Figures

SLIDE SWITCH

BACKGROUND OF THE INVENTION

The present invention relates to a slide switch and, more particularly, to a slide switch having an improved arrangement of a stationary contact.

As will be described later in detail with reference to the drawings, conventional slide switches have various drawbacks. For instance, it is often experienced that the insulation between various components of the switch may deteriorate or the switching function fail due to contamination of an insulation substrate by powders of carbide or due to accumulation of powders of metals in a sliding groove of the substrate. Although various attempts have been made to eliminate such failures these attempts have not provided a fully satisfactory solution to these problems.

SUMMARY OF THE INVENTION

Accordingly, an object of the invention is to provide an improved slide switch which can overcome the above-described problems of the prior art.

To this end, according to the invention, there is provided a slide switch comprising: an insulating substrate; a common stationary contact and stationary contact segments arranged in a row on the substrate; a movable contact attached to the manipulation side of the slide switch and adapted to slide in contact with the common stationary contact and the stationary contact segments; and a groove formed in the portion of the substrate where the common stationary contact and the stationary contact segments are arranged. The stationary contact segments and the common stationary contact are arranged to straddle over the groove, and the movable contact is adapted to slide within the width of the groove.

The above and other objects, as well as advantageous features of the invention will become clear from the following description of the preferred embodiment taken in conjunction with the accompanying drawings.

DESCRIPTION OF THE PREFERRED EMBODIMENT

Before turning to the detailed description of the preferred embodiment, an explanation will be made as to typical conventional slide switches in order to clarify the problems of the prior art and, hence, to facilitate the understanding of the present invention.

Figure 1:
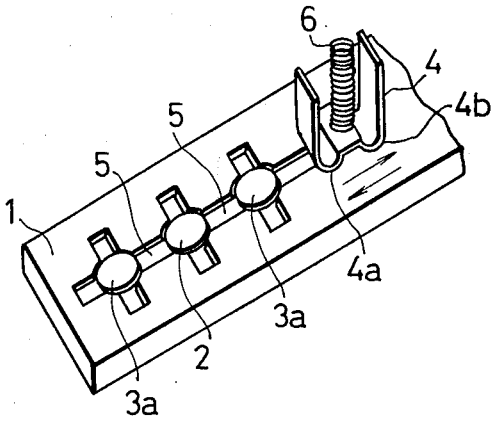
Fig.1 (PRIOR ART)
FIG. 1 is a perspective view of a conventional slide switch.

Referring to FIG. 1 showing an example of conventional slide switches, a reference numeral 1 denotes an insulating substrate on which disposed are a plurality of stationary contact segments 2,3*a*,3*a* spaced at a predetermined distance from one another in the direction of sliding movement of a movable contact 4. More specifically, the stationary contact segment 2 constitutes a stationary contact, while the stationary contact segments 3*a* are the segments for switching. Namely, the slide switch makes a switching operation between a first mode in which the movable contact segments 4*a* and 4*b* make contact with the common stationary contact 2 and one of the stationary contact segments 3*a*, respectively, and a second mode in which the movable contact segments 4*a* and 4*b* make contact with the stationary contact 2 and the other stationary contact segment 3*a*, as the movable contact 4 is moved in the directions shown by the arrows. A groove 5 is formed between the stationary contact 2 and the two stationary contact segments 3*a*. The groove 5 has a width (length in the direction perpendicular to the sliding direction) smaller than that of the movable contact segments 4*a*,4*b*. The groove 5 is adapted to receive and accomodate any powders of the metal ground from the movable contact member as a result of the sliding of the movable contact segments 4*a*,4*b*, as well as any powders of carbide formed as a result of a sparking, thereby to prevent the malfunction of the switch attributable to the any powders of metal and carbide inadvertently bridging the stationary contact elements.

A spring 6 is compressed between the movable contact 4 and a slider (not shown) of the switch to press the movable contacts 4*a*,4*b* against the stationary contact segments.

In this conventional slide switch, the groove is formed between each pair of adjacent stationary contact segments and has a width smaller than that of the movable contact. The movable contact is adapted to make a sliding movement in contact with the upper surface of the insulating substrate along the groove. Therefore, the upper surface of the insulating substrate extending along the groove is liable to be contaminated by the powders of carbide or the like to cause an insulation failure due to an electric path formed by the contaminants, as well as by the powders of metal and carbide depositing in the groove, resulting in a malfunction of the switch. The amount of generation of the powders of carbide is increased as the voltage or current applied to the contact is increased. This makes it difficult to construct a slide switch having a large contact capacity.

Figure 2:
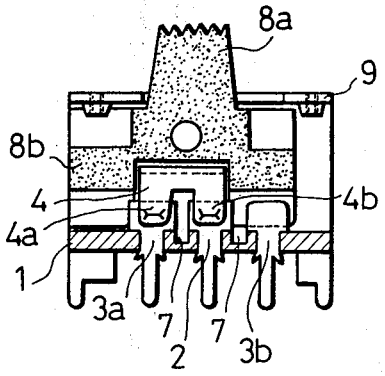
Fig.2 (PRIOR ART)
FIG. 2 is a longitudinal sectional view of another conventional slide switch.

FIG. 2 shows another example of conventional switch in which grooves 7 extending in the direction perpendicular to the sliding direction are formed between the stationary contact segments 2 and 3*a* and between the stationary contact segments 3*a* and 3*b* to increase the creeping distances between these stationary contact segments thereby to prevent the insulation failure. A reference numeral 8*a* designates a manipulating portion, 8*b* designates a slider formed as a unit with the manipulating portion and 9 designates a metallic frame for guiding the slider 8*b*.

The slide switches noted above are generally formed to have a sufficiently small size to meet conditions of use, and the distance between the contact segments is correspondingly small. It is, therefore, not possible to obtain a sufficiently large creeping distance between adjacent segments of the stationary contacts even if the grooves perpendicular to the sliding direction are formed. In consequence, the problem of insulation failure between adjacent stationary contact segments cannot be avoided even in the slide switch of the type shown in FIG. 2.

This problem, however, can be overcome by the slide switch of the present invention in which a groove is formed in the portion of an insulating substrate where the stationary contact segments are disposed so as to extend in the direction of row of the stationary contact segments, the stationary contact segments straddling the groove, and the movable contact being slidable within the width of the groove.

Figure 3:
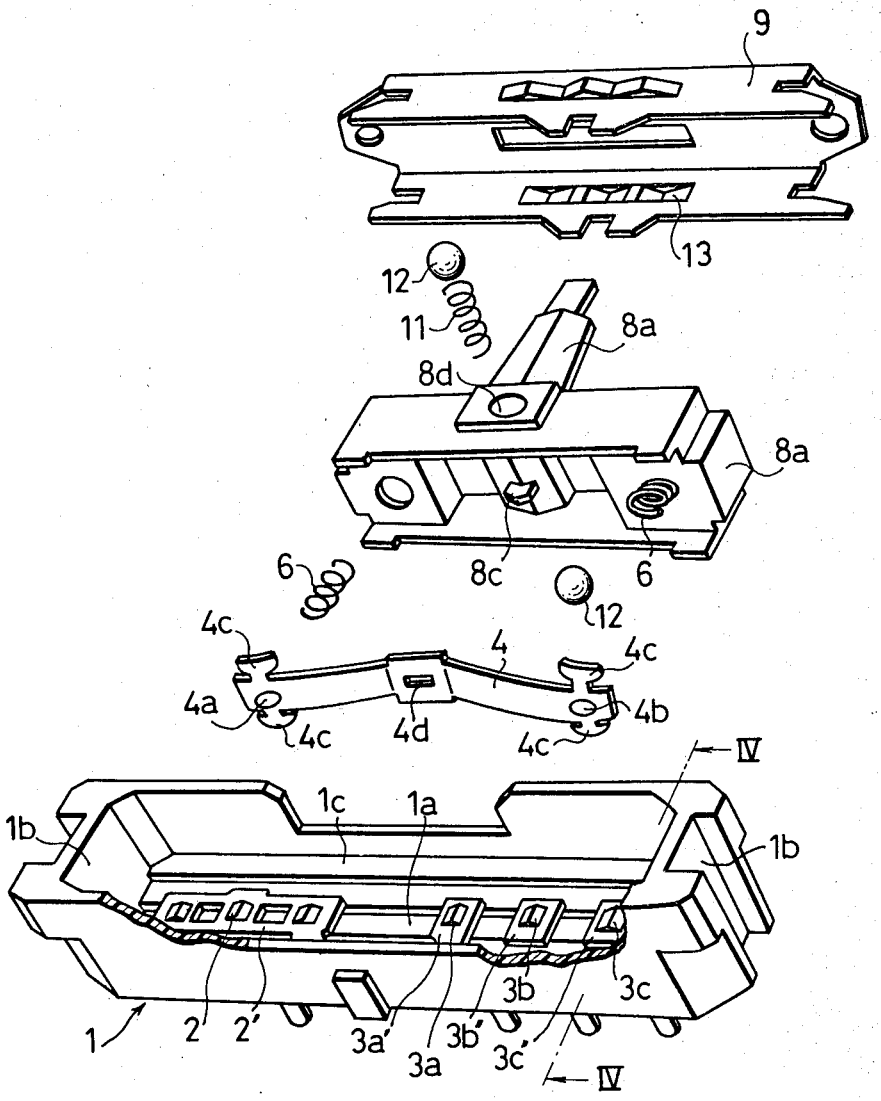
FIG. 3 is an exploded perspective view of a slide switch in accordance with an embodiment of the invention.
Figure 4:
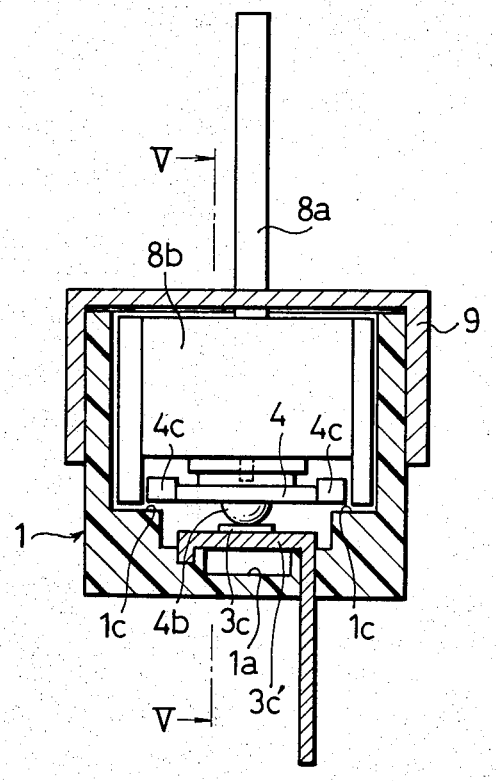
FIG. 4 is a sectional view taken along the line IV—IV of FIG. 3.
Figure 5:
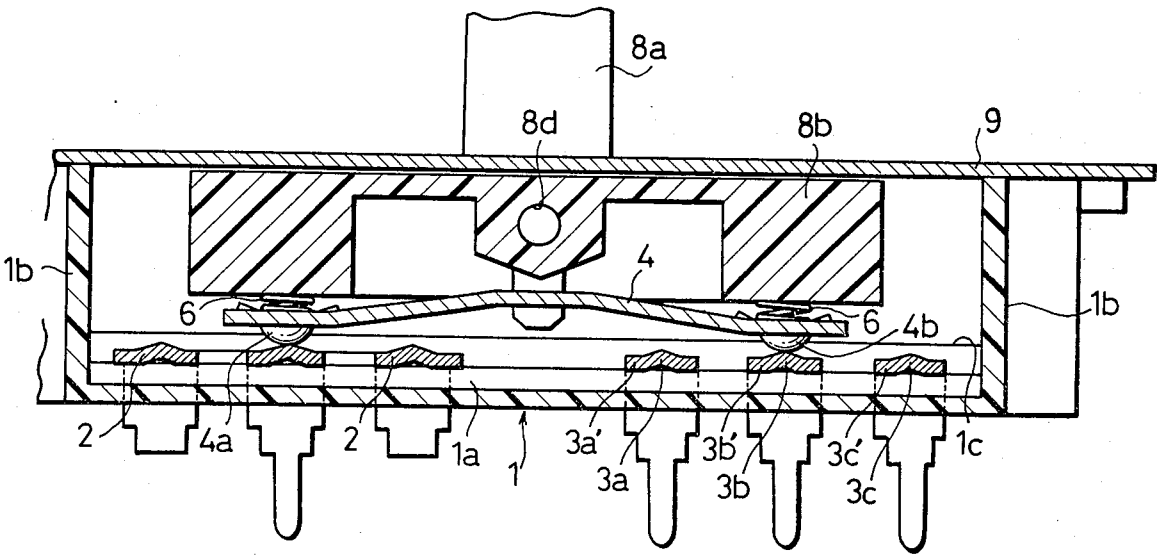
FIG. 5 is a partly cut-away sectional view along the line V—V of FIG. 4.

A preferred embodiment of the invention will be described hereinunder with reference to FIGS. 3 through 5 in which the same reference numerals are used to denote the same or equivalent parts or members of the known devices shown in FIGS. 1 and 2.

A slide switch in accordance with the preferred embodiment of the invention has an insulating substrate 1 formed generally in the shape of an open box. The insulating substrate 1 has a groove 1*a* of a predetermined width formed in the bottom plate thereof to extend along the longitudinal axis to opposing end walls 1*b*,1*b* of the substrate. Guide steps 1*c*,1*c* of a suitable height are formed on the portion of the bottom plate of the insulating substrate 1 adjacent to the side walls at respective longitudinal sides of the groove 1*a*. A plurality of stationary contact segments 2,3*a*,3*b*,3*c* are fixed at their base portions 2′,3*a*′,3*b*′,3*c*′ so as to straddle over the groove 1*a*. The stationary contact segment 2, for example, constitutes a common stationary contact while the other three segments constitutes the segments for switching. These stationary contact segments are arranged in a row with a predetermined spacing therebetween.

A movable contact 4 has an upwardly converging and downwardly diverging cross-section forming a component curve. Two movable contact segments 4*a*,4*b* are attached to respective end portions of the stationary contact 4. These segments 4*a*,4*b* are spaced from each other by a distance corresponding to the distance between the peak contact portions of the common stationary contact segment 2 and the switching stationary contact segments 3*a*,3*b*,3*c*. The movable contact segments 4*a*,4*b* have a width (length in the direction perpendicular to the sliding direction) smaller than the width of the groove 1*a*. Sliding tabs 4*c* are formed to project laterally from respective sides of each movable contact segments 4*a*,4*b*, and these tabs 4*c* are adapted to make sliding contact with associated guide steps 1*c*,1*c*. An elongated hole 4*d* formed in the center of the movable contact 4 receives a retaining projection 8*c* projected from a slider 8*b*, so that the movable contact 4 may rock around a fulcrum constituted by this projection.

A reference numeral 8*d* designates a hole extending through a central portion of the slider 8*b* and receiving a coiled spring 11. Reference numerals 12,12 designate balls which are pressed resiliently by the force of the coiled spring 11 against a series of recesses 13 formed in each side wall of the cover member or frame 9. The coiled spring 11, balls 12,12 and the recesses 13 in combination constitute a clicking mechanism providing a detent operation for the switch.

The slide switch of the invention having the construction explained heretofore operates in a manner described hereinunder.

One movable contact segment 4*a* of two movable contact segments 4*a*,4*b* is continuously held in contact with the common stationary contact segment 2 irrespective of the position of the movable contact 4. It is assumed here that the other movable contact segment 4*b* is in contact with the switching stationary contact segment 3*a*.

As the switch is manipulated at the manipulating portion 8*a*, the slider 8*b* is moved in a clicking manner due to the presence of the clicking mechanism, so that the other movable contact segment 4*b* is brought into contact with another stationary contact segment 3*b* or 3*c* thereby to effect a switching of an electric circuit or the like.

In this operation, when the movable contact segment 4*b* moves between adjacent stationary contact segments 3*a* and 3*b* or between 3*b* and 3*c*, the sliding tabs 4*c*,4*c* extended at respective sides of the movable contact segment 4*b* slide along the guide steps 1*c*,1*c* to prevent the segment 4*b* from dropping into or bearing against the groove 1*a*, and since the movable contact segment 4*b* has a width less than that of the groove 1*a*, it may fit fully within the width of the groove 1*a* and never contact the side walls of the groove. Also, due to the sliding contact between the sliding tabs 4*c*,4*c* and the associated guide steps 1*c*,1*c*, the movable contact 4 is always spaced from the bottom of the insulating substrate 1 by a predetermined distance. Namely, the movable contact 4 is prevented from making a direct sliding contact with the bottom of the insulating substrate 1 or the side walls of the groove 1*a*.

In addition, since the stationary contact segments 2,3*a*,3*b*,3*c* are raised above the groove 1*a* and straddle the groove 1*a*, the contact between these segments 2,3*a*,3*b*,3*c* and any powders of metal generated as a result of wear of the movable contact segments 4*a*,4*b* as the latter slide can be avoided almost completely, even if the powders of metal have dropped into the portions of the groove 1*a* between adjacent stationary contact segments 2,3*a*,3*b*,3*c*.

Although the groove 1*a* is illustrated to have a rectangular cross-section, this is not essential and the groove 1*a* can have other cross-sectional shapes such as a V-shaped cross-section. By adopting the V-shaped cross-section, it is possible to further increase the creeping distance. In addition, the powders of metal or the like can concentrate automatically at the bottom of the V-shaped groove. For these reasons, the V-shaped cross-section of the groove can further ensure good insulation.

As has been described, according to the invention, there is provided a slide switch in which a groove is formed in the portion of the insulating substrate where the stationary contact segments are arranged, so as to extend in the direction of a row of the stationary contact segments. The stationary contact segments straddle over the groove, and the movable contact is adapted to slide within the width of the groove. Accordingly, it is possible to avoid the contamination of the bottom surface of the insulating substrate along the groove by the powders of carbides or the like. In addition, the creeping distance between adjacent stationary contact segments can be increased. Consequently, according to the invention, insulation failure between adjacent stationary contact segments due to powders of metal and carbide can be eliminated to ensure the safe functioning of the slide switch. This in turn improves the reliability of the slide switch having a large switching capacity in which the powders of carbide or the like are formed at a large rate.

What is claimed is:

1. A slide switch comprising: an insulating substrate; a plurality of stationary contact segments constituting a common stationary contact, and a plurality of switching contact segments arranged in a row on said insulating substrate; a movable contact having movable contact segments adapted to slide in contact with said stationary contact segments; and a groove formed in the lower portion of said insulating substrate so as to extend in the direction of the row of said stationary contact segments, said stationary contact segments each being raised to a height above said groove and straddling said groove, said movable contact segments each being of a width less than that of said groove so that they may fit within said groove to avoid contacting said insulating substrate.

2. A slide switch as claimed in claim 1, further comprising means for continually holding said movable contact segments at a height sufficient for maintaining them out of contact with said insulating substrate but allowing them to engage said stationary contact segments, said means including guide steps formed on the portions of said insulating substrate at respective sides of said row of said stationary contact segments and extending fully along said row; and sliding tabs formed to extend laterally from respective sides of each of said movable contact segments, said sliding tabs being adapted to make sliding engagement with corresponding guide steps.

* * * * *